United States Patent [19]

Hanson et al.

[11] Patent Number: 4,582,500

[45] Date of Patent: Apr. 15, 1986

[54] TOY SERVICE ACCESSORY FOR SELF-PROPELLED VEHICLE

[75] Inventors: Steven P. Hanson, Richfield, Minn.; Wayne A. Kuna, River Forest, Ill.

[73] Assignee: Marvin Glass & Associates, Chicago, Ill.

[21] Appl. No.: 578,052

[22] Filed: Feb. 9, 1984

[51] Int. Cl.[4] ..... A63H 17/44

[52] U.S. Cl. ..... 446/423; 446/144

[58] Field of Search ..... 446/423, 424, 431, 448, 446/449, 476, 477, 478, 425, 483, 144; 187/8.56, 8.57

[56] References Cited

U.S. PATENT DOCUMENTS

| | | | |
|---|---|---|---|
| 1,610,005 | 12/1926 | Haag | 446/483 |
| 1,774,605 | 9/1930 | Leonhard | 187/8.57 X |
| 2,040,521 | 5/1936 | Marx | 446/423 |
| 2,497,472 | 2/1950 | Sims | 187/8.57 |

FOREIGN PATENT DOCUMENTS

| | | | |
|---|---|---|---|
| 611708 | 4/1935 | Fed. Rep. of Germany | 187/8.56 |
| 940216 | 3/1956 | Fed. Rep. of Germany | 446/483 |

*Primary Examiner*—Mickey Yu

*Attorney, Agent, or Firm*—John S. Pacocha

[57] ABSTRACT

A play service center for toy self-propelled reversible drive vehicles that includes a lift ramp powered by the vehicle. Rollers carried by the lift ramp transfer power from the driven vehicle wheels through a pinion gear that engages a stationary curved rack gear to raise and lower the lift and vehicle. At the top of the curved rack gear a number of teeth are omitted and a stop is provided to retain the lift in the raised position. In order to lower the lift, the vehicle drive is reversed. Levered pads provide additional traction for driving the vehicle off the rollers and lift ramp. A power take-off drives service equipment such as a power meter as well as a rotating buffer or drill. The meter includes a biased dial pointer that provides an indication of the power transmitted by the vehicle wheels through the driven rollers.

19 Claims, 10 Drawing Figures

TOY SERVICE ACCESSORY FOR SELF-PROPELLED VEHICLE

BACKGROUND OF THE INVENTION

1. Field of the Invention

This invention relates generally to toy self-propelled vehicle accessories and, more particularly, to a play service center with a lift ramp for a self-propelled vehicle.

2. Background Art

Various make-believe activities centering around toy vehicles, including maintenance of the vehicles, have long provided entertaining and educational pastimes for children. Prior art toys have included garage or service center sets in which a ramp or rack is provided for raising the vehicle off of the ground in a simulation of the service and lubrication ramps used by gas stations, garages and other real life vehicle service centers. Commonly, such prior art playsets use a lever to manually cam the ramp and vehicle to the raised position. While it would be desirable to have an accessory with an automatic or powered lift for the ramp as well as some powered equipment to utilize in the play maintenance of the vehicle, it would also be desirable to avoid an additional power source for such an accessory.

SUMMARY OF THE INVENTION

The present invention is concerned with providing a service center playset for a toy self-propelled vehicle in which the vehicle itself is used to power the raising and lowering of a maintenance lift ramp as well as equipment usable in the play maintenance of the vehicle. These and other objects and advantages of the invention are achieved by providing a lift ramp connected by pivotal parallel links to a base. A stationary curved rack gear is secured to the base adjacent one of the links which carries a pinion for engaging the rack gear. The lift ramp includes spaced rollers journaled for rotation with one of the rollers having a pinion gear at the end which engages a gear mounted for coaxial rotation with the link pinion. When a self-propelled vehicle wheel is supported upon the rollers and driven in one direction, the link pinion will ride up the curved rack gear raising the lift. To lower the lift, the vehicle drive is shifted to reverse. Levered pads carried by the base and disposed below and between the rollers when the lift is in the lowered position are used to provide additional traction for the vehicle wheels to drive the vehicle off of the rollers and lift ramp. Another of the rollers provides a power take-off for driving a power meter plus other equipment, such as a rotating buffer or drill, for use in the play maintenance of the toy vehicle. The power meter includes a biased dial pointer that provides an indication of the power transmitted through the lift ramp rollers by the vehicle wheels.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
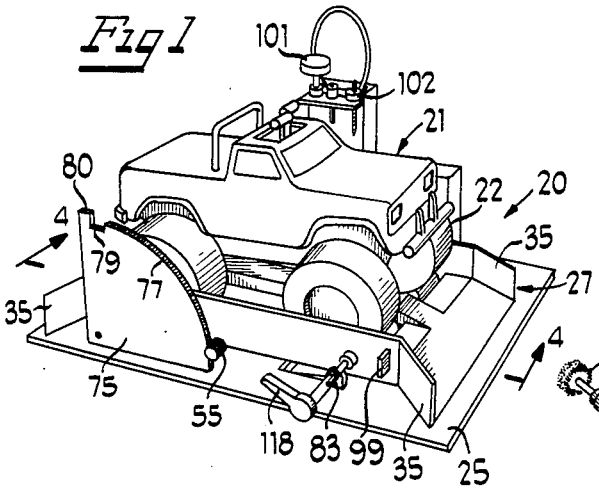
FIG. 1 is a perspective view of an embodiment of the present invention showing the lift in the lowered position.
Figure 2:
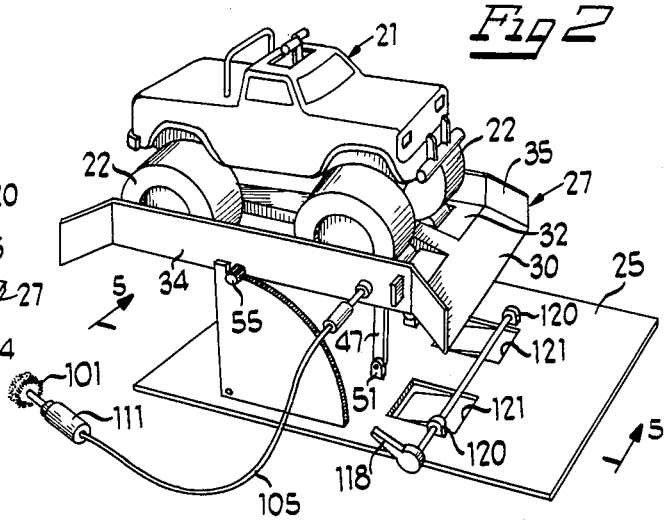
FIG. 2 is a perspective view of the same embodiment showing the lift in the raised position.

Referring now to the drawings in which like parts are designated by like reference characters throughout the several views, there is shown in FIG. 1 a service lift ramp accessory 20 for a toy self-propelled vehicle such as the Playskool "BIG FOOT" vehicle 21 shown in FIGS. 1 and 2. The "BIG FOOT" vehicle 21 not only has selective forward and reverse drive but also has selective two-wheel and four-wheel drive. Thus, all of the wheels 22 on the axles 23 may be driven. In addition, the vehicle 21 has a substantially centrally disposed elongated transmission housing 24 on the underside of the vehicle that extends between the axles 23 and is spaced from the wheel supporting surface a distance less than the radius of the wheels 22. An accessory similar to 20 may be used with any self-propelled vehicle having at least one wheel selectively drivable in the forward and reverse directions.

Service lift ramp accessory 20 has a base 25 comprising a generally rectangular, flat piece of plastic or metal that remains relatively stable during play with the accessory 20. Mounted on the base 25 for movement between a lowered position as shown in FIG. 1 and a raised position as shown in FIG. 2 is a drive-on lift ramp 27. In the lowered position, lift ramp 27 is spaced from the base 25. Accordingly, the lift 27 is provided with downwardly angling, flared out entrance and exit ramps 29 and 30, respectively. Each of the entrance and exit ramps has a short generally horizontal portion 31 and 32, respectively, extending in from the uppermost edge of the angled ramp. A pair of opposed side walls 33 and 34 are spaced apart throughout most of their length a distance somewhat greater than the axial span of each set of vehicle wheels 22. At each end, each of the side walls 33 and 34 has an outwardly angling portion 35 that conforms to the outward flare of the respective entrance or exit ramp.

Extending from the entrance to the exit end and generally centrally disposed is a raised center support 37. A substantial portion of the top surface 38 of the support 37 is generally horizontally disposed. However, at the entrance and exit ends, the support 37 is provided with inclined surfaces 39 and 40, respectively. These inclined surfaces are conveniently at the same angle as the entrance and exit ramps 29 and 30, respectively. At the upper end of the entrance incline 39 there is a wedge 42 mounted on the support 37 which includes an angled surface 43 that may be disposed at the same angle as, but is preferably a sharper angle than, the entrance ramp 29 and entrance incline 39. Wedge 42 also includes a relatively short, generally horizontal surface 44.

Lift 27 is mounted on the base 25 by means of two pairs of parallel pivoting links 46 and 47, respectively. Each link 46 is connected for pivotal movement at the base end to an upwardly projecting stud 48 by means of a pin 49. Studs 48 are spaced apart a distance substantially greater than the width of the support 37 but less than the distance between the side walls 33 and 34 so that each of the links 46 is disposed adjacent to, but inboard of, a respective side wall. The other set of links 47 are similarly pivotally connected at the base end to studs 51 on the base 25. Studs 51 are spaced apart a shorter distance than studs 48 and are positioned adjacent either side of the center support 37. A pin 52 is secured between the studs 51 trapping the links 47 between a stud 51 and a side of the center support 37 while permitting pivotal movement about the pin 52. All of the studs 48 and 51 may be secured to, or integrally formed with, the base 25.

Shaft 54 passes through each of the links 46 adjacent the lift end permitting rotation of the shaft 54 relative to the links. Shaft 54 is also journaled for rotation through the center support 37 and through each of the side walls 33 and 34. A pinion gear 55 is secured to each projecting end of the shaft 54 for rotation with the shaft. Also secured to the shaft for rotation with the shaft is a coaxial spur gear 56 inboard of one of the pinions 55 and outside of the side wall 33. Conveniently, a spacer 58 is positioned between the spur gear and the side wall 33 to maintain the required axial positioning of the gears.

Four rollers 60 are mounted on the lift 27 to support and be driven by the front wheels of a four-wheel drive vehicle such as 21. One pair of rollers 60 is secured to a shaft 62 that is journaled for rotation through the center support 37 and bushings 63 and 64 in side walls 33 and 34, respectively. Shaft 62 extends through the bushing 63 and has a drive pinion 66 secured to the end of the shaft for rotation with the shaft. Drive pinion 66 engages the spur gear 56 causing shaft 54 and pinions 55 to rotate in the opposite direction from which the rollers on shaft 62 are driven. Links 47 are each conveniently provided with a notch 67 to accommodate the shaft 62 in the lowered position of the lift.

The other pair of rollers 60 is similarly mounted on a shaft 69 for rotation with the shaft. Again, shaft 69 passes through the center support 37 and is journaled for rotation in each of the side walls 33 and 34. Shaft 69 also functions as the pivotal connection of the lift end of the parallel links 47. While rollers 60 may be secured to the respective shafts 62 and 69 by press fit, a set screw 70 may also be used. Spacers 72 are provided between the links 47 and the rollers 60 on shaft 69 and a shorter outside spacer 73 is positioned between each roller and the adjacent side wall. Similar spacers may be provided on the shafts 62 and 54.

Extending upwardly from the base 25 is a spaced apart pair of upright quarter circle segments 75 which may be secured to or integrally formed with the base 25. Each of the pins 49 is inserted through the respective side wall and into one of the segments adjacent the intersection of the bottom and vertical edges. Between the side wall 33 and the adjacent segment there is a spacer 76. The curved peripheral edge of each segment 75 has a rack gear 77 that meshes with a pinion gear 55 throughout most of the length of the curved edge. Near the top of the curved rack gear 77 there is a smooth toothless notch 79 between the end of the rack 77 and an upstanding end stop 80. As the pinions 55 rotate in a counterclockwise direction as viewed in FIGS. 4 and 5, the pinion 55 will ride up the curved rack 77 to raise the lift 27 from the lowered position shown in FIG. 4 to the raised position shown in FIG. 5.

Four-wheel reversible drive vehicle 21 is driven onto the lift 27 in four-wheel forward drive up the entrance ramp 29. Once the front wheels leave the ramp 29 and the inward horizontal extensions 31, the transmission housing 24 rides on the top surface of the center support 37. Although the front wheels may contact the top edges of the links 46, the front wheels are essentially spaced from any supporting surface at the time the transmission housing rides up over the entrance angle 39 and the wedge angle 43. However, the rear wheels continue to move the vehicle 21 on to the lift 27. The rollers 60 are so spaced with respect to the vehicle 21 that once the front wheels 22 are supported upon the rollers 60, the rearward end of the transmission housing 24 has ridden up the wedge angle 43 spacing the rear wheels from any traction providing surface. While the front wheels are supported by the rollers 60, the vehicle is substantially prevented from linear movement since the driven front wheels cause the rollers 60 to rotate preventing the vehicle from obtaining sufficient purchase to translate the rotational movement to linear movement.

Figure 4:
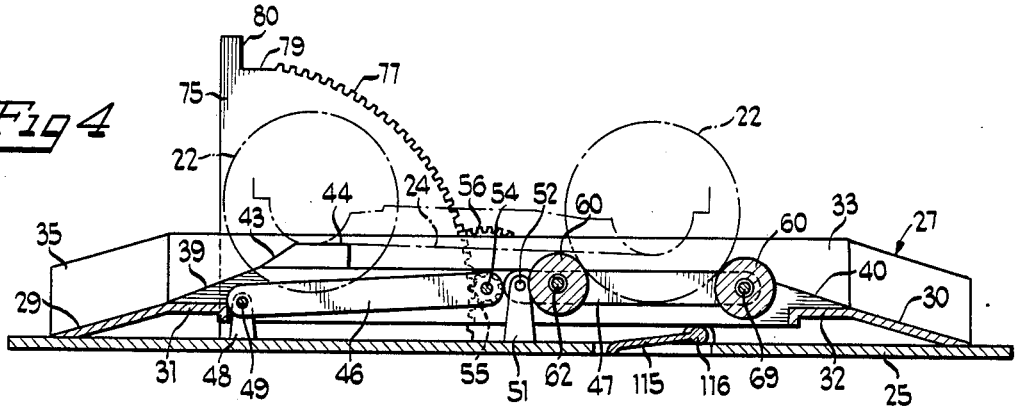
FIG. 4 is an enlarged scale, sectional view taken substantially along the line 4—4 of FIG. 1.
Figure 5:
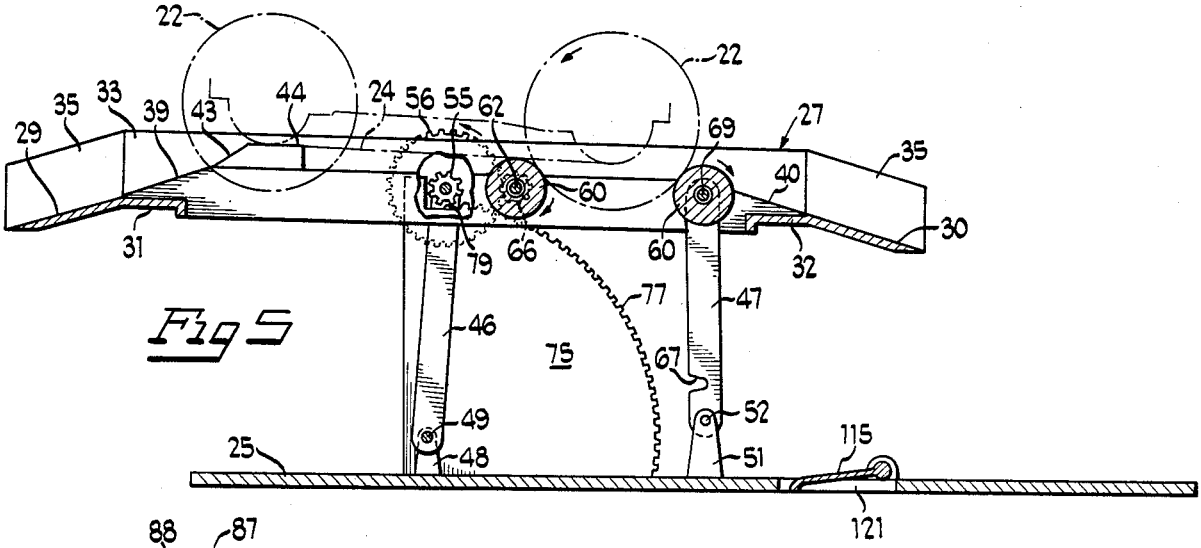
FIG. 5 is an enlarged scale, sectional view taken generally along the line 5—5 of FIG. 2.

After the vehicle is in the raised position as shown in FIGS. 1 and 4, the vehicle drive is reversed causing the wheels 22 as shown in FIGS. 4 and 5 to rotate in a counterclockwise direction. The rearward pair of rollers 60 on shaft 62 are then driven in a clockwise direction along with drive pinion 66. Spur gear 56 and pinions 55 are in turn driven in a counterclockwise direction causing each of the pinions 55 to ride up the respective curved rack gear 77. When the pinion 55 reaches the upper end of the rack 77, it abuts the stop 80 and spins on the smooth edge 79. The vehicle drive may then be shut off and the vehicle will remain in the raised position on the lift 27. Alternatively, the vehicle drive may remain on to power equipment provided with the accessory 20 for play maintenance of the vehicle.

Figure 6:
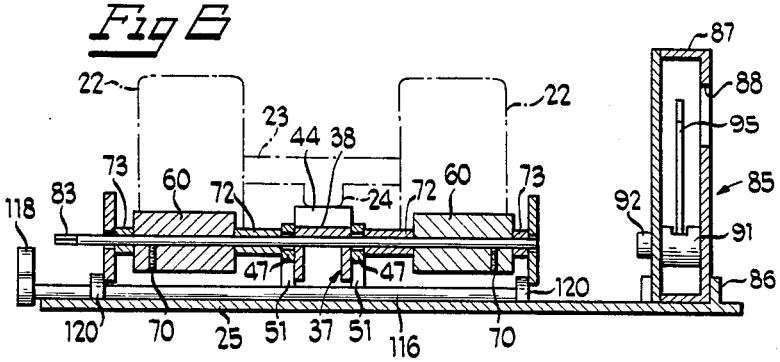
FIG. 6 is a sectional view taken generally along the line 6—6 of FIG. 3.
Figure 8:
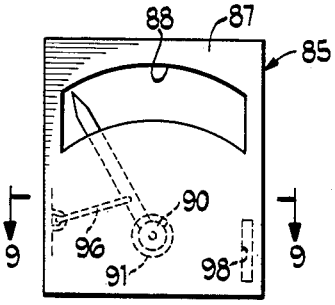
FIG. 8 is an enlarged scale, side elevational view of the power meter.
Figure 10:
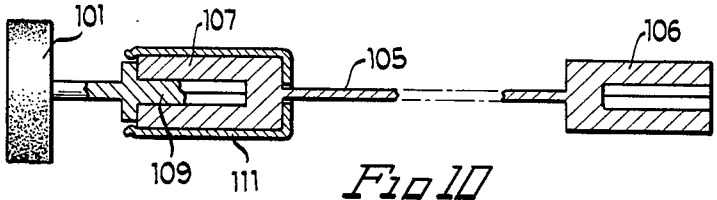
FIG. 10 is an enlarged scale, partial sectional, view of an attachment for the power take-off.
Figure 9:
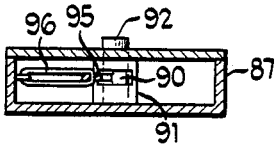
FIG. 9 is a sectional view taken generally along the line 9—9 of FIG. 8.

Power for the maintenance equipment is provided through the shaft 69 which extends out beyond the side wall 34 in a squared power transmitting end 83. The play maintenance equipment includes a power meter 85 which is best shown in FIGS. 6, 8 and 9. The power meter may be stored in a receptacle 86 secured to, or integrally formed with, the base 25. Power meter 85 is housed in a rectangular box 87 with an arcuate opening 88 in one side adjacent the upper end of the box. Between the sides of the box there is a shaft 90 journaled for rotation in a bushing 91 with one end of the shaft 92 projecting out of the side opposite the side having the arcuate opening. The projecting end 92 is keyed to receive the squared end of the power take-off shaft 83 in power transmitting engagement. Secured to the shaft 90 for pivotal movement with the shaft is a dial pointer 95. As viewed in FIG. 8 the dial pointer 95 is biased against movement in a clockwise direction by an elastic band 96 attached to the pointer and to a stationary end wall of the box 87.

In the side of the power meter box through which the shaft end 92 projects there is a vertical slot 98 which receives a tab 99 projecting from the wall 34 of the lift 27. When the power take-off shaft is inserted into the keyed opening of the projecting shaft 92, slot 98 and tab 99 secure the power meter 85 against rotational movement about the shaft 83. With the vehicle wheels 22 rotating counterclockwise in the reverse drive direction as shown in FIG. 5, the forward set of rollers 60 secured to the shaft 69 with power take-off end 83 will rotate in a clockwise direction and will pivot the dial pointer 95 of the power meter in a clockwise direction against the bias of the elastic band 96. Thus, the child may obtain some indication of the amount of power being transmitted by the vehicle through the rollers 60 while it is in the raised position on the lift 27.

Additional powered equipment such as a rotary buffer 101 or a drill 102 may also be driven by the vehicle in the raised position on the lift 27. For the purpose of driving rotary equipment such as the buffer 101, a flexible drive shaft 105 which has keyed sockets 106 and 107 at either end is provided. Socket 106 fits over and engages the squared end 83 of the shaft 69 while the socket 107 receives a squared end 109 of a rotary tool such as the buffer 101. Sleeve 111 surrounds the socket 107 and provides the child with a handle to hold while manipulating the rotating tool in the play maintenance of the vehicle.

When a child wishes to lower the lift ramp and vehicle, the vehicle is placed in forward drive causing the pinions 55 to rotate in a clockwise direction and, perhaps after some slippage, engage the curved rack 77 to lower the lift 27 to the position shown in FIGS. 1 and 4. After the ramp 27 has been lowered, the vehicle will continue to spin on the rollers 60. In order to provide the vehicle 21 with the additional traction necessary to drive off of the exit ramp 30, the base is provided with levered pads 115.

Figure 7:
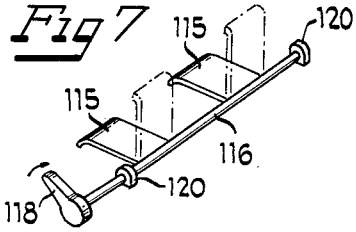
FIG. 7 is a perspective view of the levered projection.
Figure 3:
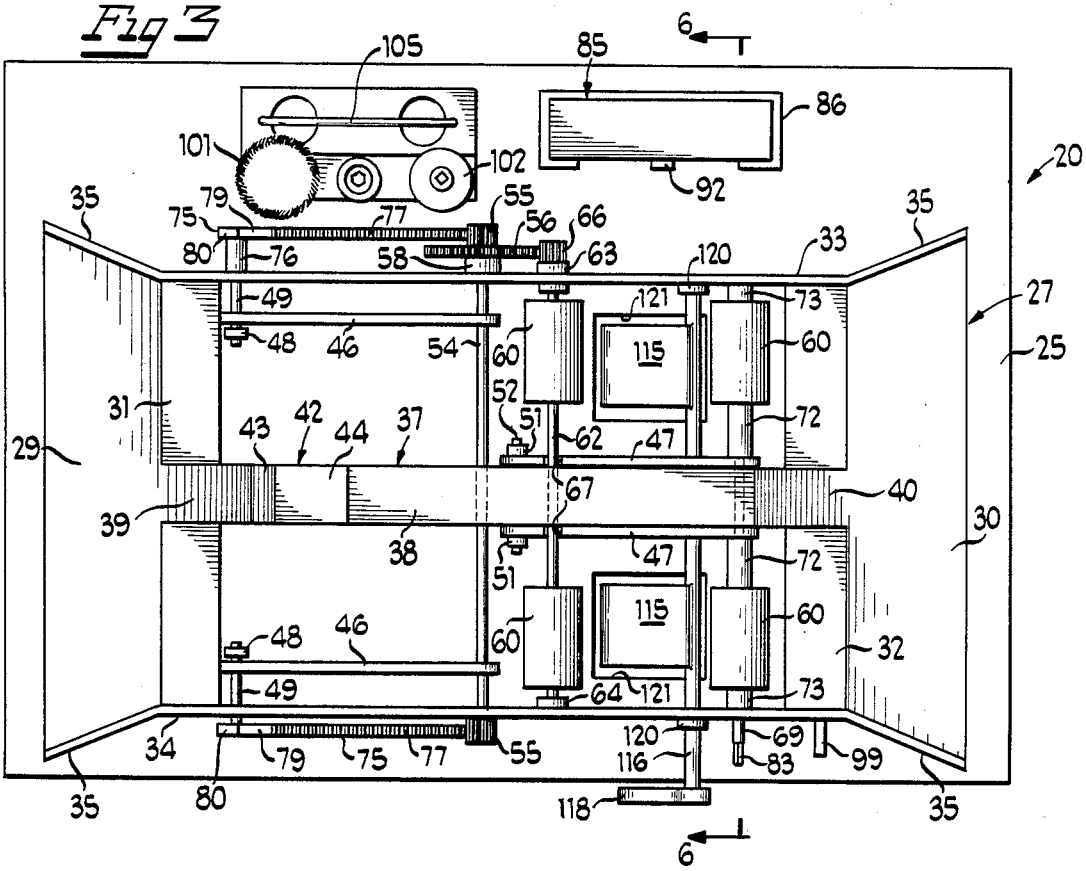
FIG. 3 is an enlarged scale, top plan view of the lift.

Each of the pads 115 is secured to a shaft 116 for pivotal movement with the shaft and a lever handle 118 is secured at one end. Shaft 116 is journaled for pivotal movement in posts 120 projecting upwardly from the base 25. Posts 120 may be secured to or integrally formed with the base 25. In their lowered position the pads 115 rest within recesses 121 provided in the base 25. By pivoting of the lever handle 118 in the direction of the arrow shown in FIG. 7, the pads are raised to the position shown in phantom. The pads are disposed between the rollers 60 so as to engage the front wheels of the vehicle when the pads are raised. When the forward rotating front vehicle wheels engage the upwardly levered pads 115, sufficient traction or purchase is provided for the front wheels to pull the vehicle onto the horizontal extensions 32 and then on down the exit ramp 30.

As an alternative, the ramp 29 of the lift could be eliminated and that end closed off and the wedge 42 reversed so that the wedge angle 43 is inclined toward the ramp 30. As so modified the vehicle 21 would be backed onto the lift 27 and automatically raise itself since it would already be in a reverse drive. Lowering of the vehicle and subsequent exiting from the ramp would be accomplished as previously described.

The present invention has been shown and described for use with a four-wheel drive toy vehicle. However, the accessory 20 may also be modified for use with a two-wheel drive vehicle by moving the rollers toward the rear so that they could be driven by the rear wheels which are normally the driven set of wheels in a two-wheel drive toy vehicle. In such a modification, the segments having the curved rack gears would be moved toward the front. For two-wheel drive vehicles it may also be necessary to provide the lift with additional ramp surfaces for the two driven wheels to remain in engagement with a surface until just before they ride onto the rollers.

While a particular embodiment of the present invention has been shown and described with some alternatives, other changes and modifications will occur to those skilled in the art. It is intended in the following claims to cover all such changes and modifications as fall within the true spirit and scope of the present invention.

What is claimed as new and desired to be secured by Letters Patent is:

1. A toy self propelled wheeled vehicle service accessory comprising:

a base;

a lift;

means connecting the lift to the base for movement of the lift from a lowered position adjacent the base to a raised position above the base;

a gear carried for rotation by the lift;

means for transferring the propelled rotation of the vehicle wheels to the lift;

a rack attached to the base and engageable by the lift gear so that rotation of the lift gear in one direction will move the lift from the lowered position to the raised position and reverse rotation of the gear will return the lift from the raised position to the lowered position;

the rack having a lower end tooth and an upper end tooth;

the end teeth being spaced both vertically and horizontally from each other;

the rack including stop means adjacent the upper end tooth; and the stop means including a vertical projection and a space without teeth between the projection and the upper end tooth.

2. The toy accessory of claim 1 in which the connecting means includes:

two pairs of spaced parallel links;

each link having a lift end and a base end;

each lift end being pivotally connected to the lift; and each base end being pivotally connected to the base.

3. The toy accessory of claim 2 in which means pivotally connecting the lift end of one link to the lift also carries the lift gear.

4. The toy accessory of claim 1 in which the transfer means includes rollers mounted on spaced shafts to support the wheels of the vehicle.

5. The toy accessory of claim 4 in which at least one of the rollers drives the lift gear.

6. The toy accessory of claim 4 in which at least one of the rollers is mounted on a shaft for rotation with the shaft.

7. The toy accessory of claim 4 including means providing selective traction assistance to the wheels of the vehicle supported on the rollers.

8. The toy accessory of claim 7 in which the traction assistance means includes a pad mounted on the base between and below the spaced rollers for pivotal movement from a position out of engagement with the propelled vehicle wheels into engagement with the wheels.

9. The toy accessory of claim 1 in which the rack is curved.

10. The toy accessory of claim 9 in which the rack is on the peripheral edge of a circle segment.

11. The toy accessory of claim 1 including means for providing a power take-off from the propelled rotation of the vehicle wheels.

12. The toy accessory of claim 11 in which the means for providing a power take-off includes rollers mounted on spaced shafts supporting the propelled vehicle wheels.

13. The toy accessory of claim 12 in which at least one of the rollers drives the power take-off.

14. The toy accessory of claim 12 in which at least one of the rollers is mounted on a shaft for rotation with the shaft.

15. The toy accessory of claim 12 including a meter providing an indication proportional to the power transmitted by the propelled vehicle wheels through the rollers.

16. The toy accessory of claim 15 including rotating equipment having a flexible drive connection between the equipment and the power take-off.

17. A toy self-propelled wheeled vehicle service accessory comprising:

a base;

a lift;

means connecting the lift to the base for movement of the lift from a lowered position adjacent the base to a raised position above the base;

a gear carried for rotation by the lift;

means for transferring the propelled rotation of the vehicle wheels to the lift;

a rack attached to the base and engageable by the lift gear so that rotation of the lift gear in one direction will move the lift from the lowered position to the raised position and reverse rotation of the gear will return the lift from the raised position to the lowered position;

means including rollers mounted on spaced shafts supporting the propelled vehicle wheels for providing a power take-off from the propelled rotation of the vehicle wheels; and rotating equipment having a flexible drive connection between the equipment and the power take-off.

18. The toy accessory of claim 17 including a meter providing an indication proportional to the power transmitted by the propelled vehicle wheels through the rollers.

19. A toy self-propelled wheeled vehicle service accessory comprising:

a base;

a lift;

means connecting the lift to the base for movement of the lift from a lowered position adjacent the base to a raised position above the base;

a gear carried for rotation by the lift;

means for transferring the propelled rotation of the vehicle wheels to the lift;

a rack attached to the base and engageable by the lift gear so that rotation of the lift gear in one direction will move the lift from the lowered position to the raised position and reverse rotation of the gear will return the lift from the raised position to the lowered position;

means including rollers mounted on spaced shafts supporting the propelled vehicle wheels for providing a power take-off from the propelled rotation of the vehicle wheels;

a meter providing an indication proportional to the power transmitted by the propelled vehicle wheels through the rollers; and means mounting the meter on the lift to secure the meter against rotational movement when the lift is in the raised position.

* * * * *